US005119727A

United States Patent [19]

Miyamoto et al.

[11] Patent Number: 5,119,727

[45] Date of Patent: Jun. 9, 1992

[54] INKING APPARATUS FOR PRINTING PRESS

[75] Inventors: Toshio Miyamoto; Hiroyuki Sugiyama, both of Toride, Japan

[73] Assignee: Komori Corporation, Tokyo, Japan

[21] Appl. No.: 629,415

[22] Filed: Dec. 18, 1990

[30] Foreign Application Priority Data

Jan. 10, 1990 [JP] Japan ..... 2-1452

[51] Int. Cl.[5] ..... B41F 31/00

[52] U.S. Cl. ..... 101/352; 101/350; 101/DIG. 38; 101/348

[58] Field of Search ..... 101/352, 351, 350, 349, 101/348, DIG. 38

[56] References Cited

U.S. PATENT DOCUMENTS

| | | | |
|---|---|---|---|
| 1,130,727 | 3/1915 | Halliwell | 101/DIG. 38 X |
| 1,313,433 | 8/1919 | Walser | 101/DIG. 38 X |
| 3,678,849 | 7/1972 | Musgrave | 101/157 |
| 3,774,537 | 11/1973 | Christoff | 101/219 |
| 3,814,014 | 6/1974 | Dahlgren | 101/137 |
| 3,890,897 | 6/1975 | Christoff | 101/148 |
| 3,983,812 | 10/1976 | Schramm | 101/349 |
| 4,373,442 | 2/1983 | Dahlgren et al. | 101/207 |
| 4,385,559 | 5/1983 | Jarach | 101/148 |
| 4,603,254 | 9/1971 | Siebke | 101/148 |
| 4,711,174 | 12/1987 | Beisel | 101/352 |
| 4,739,703 | 4/1988 | Eguchi | 101/349 |
| 4,960,053 | 10/1990 | Hummel et al. | 101/350 |
| 5,003,874 | 4/1991 | Junghans | 101/348 |

FOREIGN PATENT DOCUMENTS

| | | | |
|---|---|---|---|
| 1320080 | 6/1987 | U.S.S.R. | 101/348 |

*Primary Examiner*—Edgar S. Burr
*Assistant Examiner*—Eric Raciti
*Attorney, Agent, or Firm*—Abelman Frayne and Schwab

[57] ABSTRACT

In an inking apparatus for a printing press, a rotary lever is rotated by adjusting means disposed between a roller arm and the rotary lever around an axis parallel to a swing shaft of the roller arm to move a cam follower mounted to the rotary lever, and a cam mounted coaxially with a plate cylinder is rotated by cam driving means to select pressing state and unpressing state of the ink form roller through the cam follower, thereby preventing the nip pressure from being varied by skewing adjustment of the plate cylinder.

6 Claims, 5 Drawing Sheets

INKING APPARATUS FOR PRINTING PRESS

BACKGROUND OF THE INVENTION

This invention relates to an inking apparatus for a printing press, which can easily control the contact pressure of ink form rollers on the surface of a printing plate mounted on a plate cylinder, thus eliminating the need for readjustment of the contact pressure after skewing adjustment of the plate cylinder.

Heretofore, an inking apparatus mounted on printing presses such as a rotary printing press is provided with an ink fountain and a plurality of rollers. Ink charged in the ink fountain is picked up by rotation of ink fountain rollers and is applied as a film of ink onto the surface of the forming rollers. Furthermore, the film of ink is kneaded and spread in all directions while being transferred between the rollers, and is then supplied by the ink form rollers to the plate surface on the plate cylinder.

In the above inking apparatus, the contact pressure between the ink form rollers and the plate surface, that is, a so-called nip pressure, has tended to vary with changes in diameter of the ink form rollers due to thermal expansion, abrasion, and finishing of the plate cylinder. Since the nip pressure largely affects the quality of printed matter, the inking apparatus is provided with a nip pressure adjusting device to adjust the nip pressure in the preparation stage for printing or during printing.

As such a nip pressure adjusting device, there has been known, for example, one which is disclosed in Japanese Patent Publication Laid-open No. 58-175663/1983. In this device, ink form rollers are individually supported by swingable roller arms, and the roller arms are urged by spring members with adjustable urging force so that the ink form rollers are pressed against the plate surface.

Furthermore, when the printing plate is mounted to the plate cylinder of the printing press, the printing plate may be slightly skewed with respect to the plate cylinder, and the individual ends of the printing plate may become shifted peripherally from each other in the reverse directions, resulting in a mis-registration between the right and left sides. In this case, eccentric bearings rotatably supporting the rotary shaft of the plate cylinder on the frames of the printing press are turned to correct the error of registration, that is, so-called skewing adjustment is made.

However, with the above nip pressure adjusting device, skewing adjustment of the plate cylinder varies the already adjusted nip pressure. Then, the nip pressure must be adjusted again, requiring additional time and labor.

OBJECT OF THE INVENTION

With a view to obviating the above prior art defects of inking apparatus, it is a primary object of the present invention to provide an inking apparatus for a printing press, with a mechanism which is simple in structure, easy to assemble, and low in production cost, and which prevents the nip pressure from being varied due to skewing adjustment of the plate cylinder, thereby eliminating the need for readjustment of the nip pressure after skewing adjustment of the plate cylinder.

SUMMARY OF THE INVENTION

In accordance with the present invention, there is provided an inking apparatus comprising roller arms with rear ends swingably supported on frames supporting vibrating rollers, ink form rollers with both ends rotatably supported on front ends of the roller arms, and pressure members exerting a rotating force on the roller arms to press the ink form rollers against a printing plate on the surface of the plate cylinder. A rotary lever is rotatably mounted to a shaft parallel to the swing shaft of the roller arms, a cam is mounted coaxially with the plate cylinder for selecting the pressing state and unpressing state of the ink form rollers to the plate cylinder through a cam follower mounted to the rotary lever. A cam driving means is provided for driving the cam, and an adjusting means is disposed between the roller arms and the rotary lever for varying the pressing force of the ink form rollers to the plate cylinder by varying the relative positions between the ink form rollers and the cam follower through rotation of the rotary lever relative to the roller arms.

When not printing, the cam driving means rotates the cam with respect to the plate cylinder so that the cam follower is raised from the plate cylinder side against the pressing force of the pressure members. As a result, the ink form rollers are separated from the plate cylinder to set the rollers to an unpressing state.

During printing, the cam driving means turns the cam relative to the plate cylinder so that the ink form rollers are pressed against the plate cylinder by the pressing force of the pressure members.

Furthermore, during printing, when the rotary lever is rotated by the adjusting means, the position of the cam follower is varied relative to the roller arms. Therefore, turning position of the cam follower is varied relative to the ink form rollers supported by the rollers. As a result, the ink form rollers are moved in the radial direction of the plate cylinder, and pressing force of the ink form rollers to the printing plate is varied.

When the plate cylinder is skew adjusted, the cam which is mounted to the plate cylinder is also moved with the plate cylinder, such that the cam follower pressed against the cam is also moved. Therefore, relative positions of the ink form rollers and the plate cylinder are not changed, and the pressing force, that is, the nip pressure, is not varied.

DETAILED DESCRIPTION OF THE PREFERRED EMBODIMENTS

An embodiment of the inking apparatus for a printing press according to the present invention is shown in FIGS. 1 to 5, and the present invention will be described with reference to these drawings.

Figure 1:
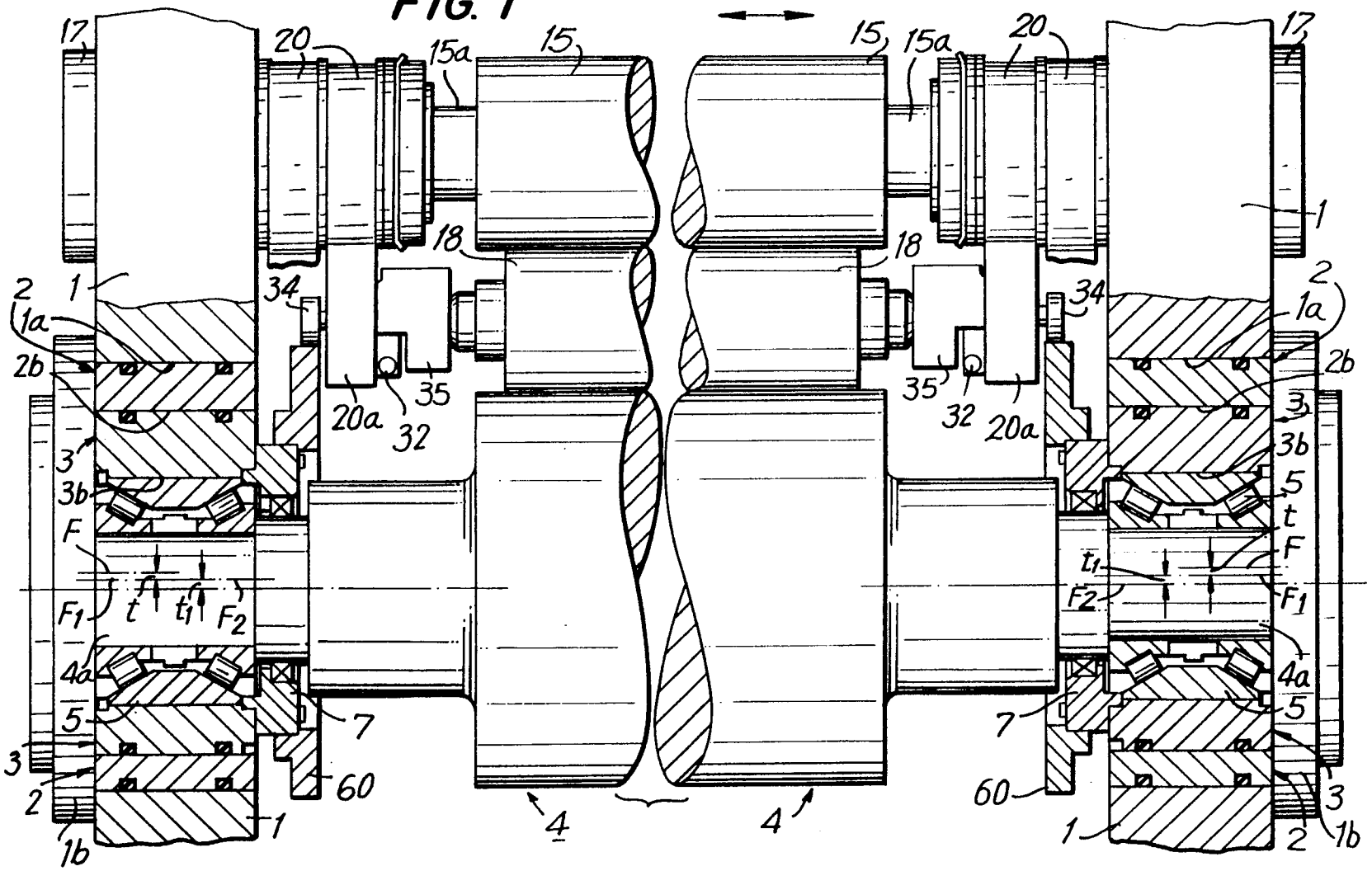
FIG. 1 is a schematic cross sectional view showing part of the inking apparatus for a printing press of an embodiment according to the present invention.

As shown in FIG. 1, a pair of bearing bores 1*a* formed in right and left frames 1 rotatably support first eccentric rings 2 having a center $F_1$, and having bores 2b eccentrically shifted by t with respect to shaft center F of the bores 1a. The inner bores 2b of the pair of first eccentric rings 2 are provided with second eccentric rings 3, rotatable with respect to the first eccentric rings 2, with center $F_2$ of inner bores 3b eccentrically shifted by $t_1$. A pair of rotary shafts 4a of a plate cylinder 4, mounted with a printing plate on its peripheral surface and contacting a blanket cylinder (not shown), are rotatably supported in the inner bores 3b of the pair of second eccentric rings 3, through roller bearings 5. The roller bearings 5 are held by retainer plates 1b mounted to the frames 1, and thereby are prevented from shifting axially.

Thus, the shaft center of the plate cylinder 4 is coaxial with the center $F_2$ of the inner bores 3b of the second eccentric rings 3, and is rotatable about center $F_2$ with respect to the frames 1.

Therefore, when the right and left first eccentric rings 2 are turned by a same angular phase, the plate cylinder 4 makes an eccentric movement about the shaft center F, and thus the contact pressure between the plate cylinder 4 and the blanket cylinder (not shown) is adjusted.

In this state, if one of the second eccentric rings 3 of the right and left frames 1 is rotated, the contact pressure to the blanket cylinder does not change, but, the outer periphery of the plate cylinder 4 at the rotated side is adjusted by a fine eccentric movement about $F_1$. By this fine adjustment, a skewing adjustment of the plate cylinder 4 is made to correct for misregistration of the printing plate.

Figure 2:
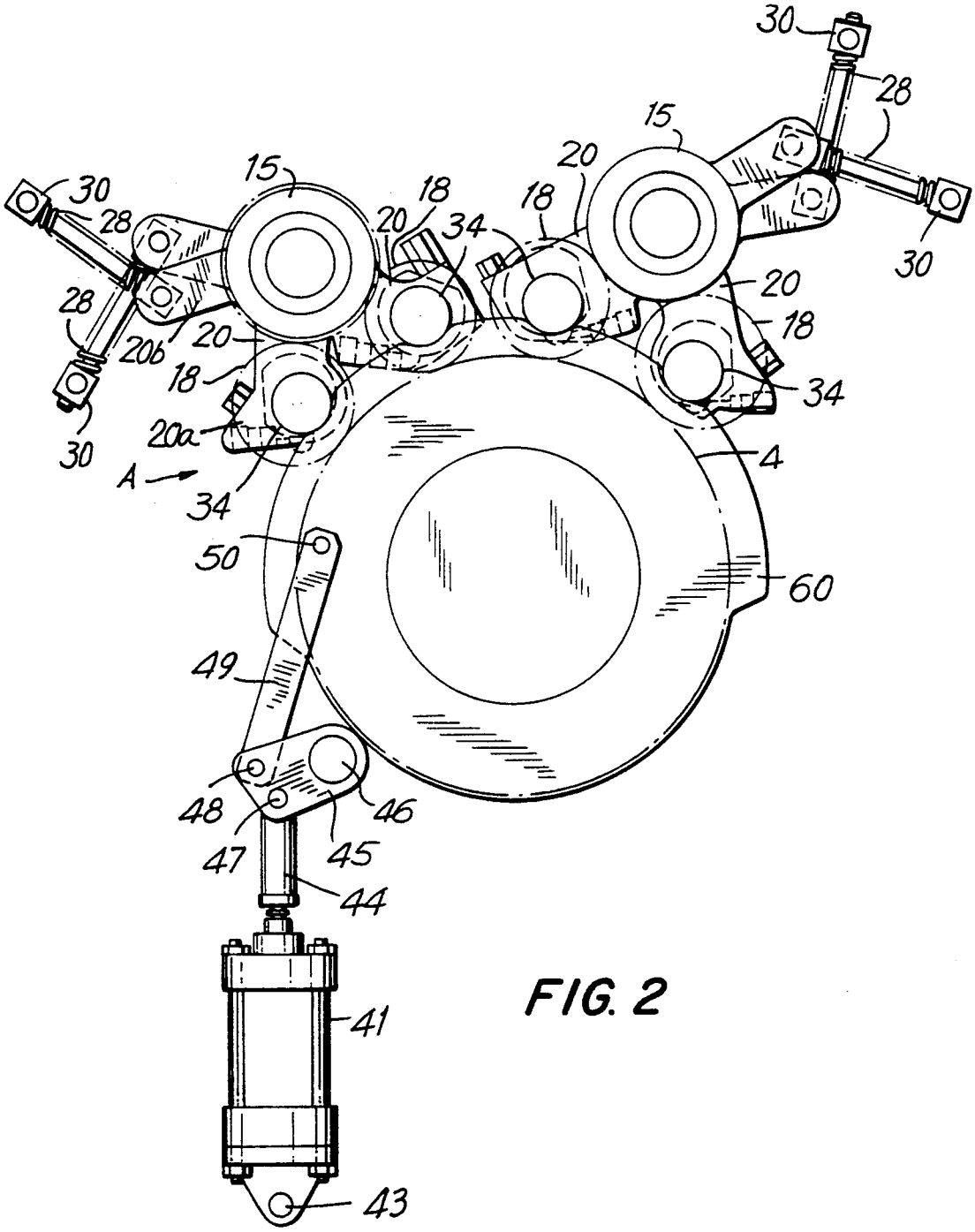
FIG. 2 is a schematic plan view of the inking apparatus for a printing press according to the present invention.

As shown in FIGS. 1 and 2, above the plate cylinder 4 of the above-described arrangement, a pair of vibrating rollers 15 are rotatably supported through bearings 17. Each of these vibrating rollers 15 is provided with a vibration mechanism (not shown), and the vibrating rollers 15 are rotated by a driving source (not shown) to make a reciprocal movement with a predetermined period in a direction parallel to the axis of the vibrating rollers 15.

Furthermore, each of the vibrating rollers 15 rotatably contacts a pair of ink form rollers 18.

Figure 5:
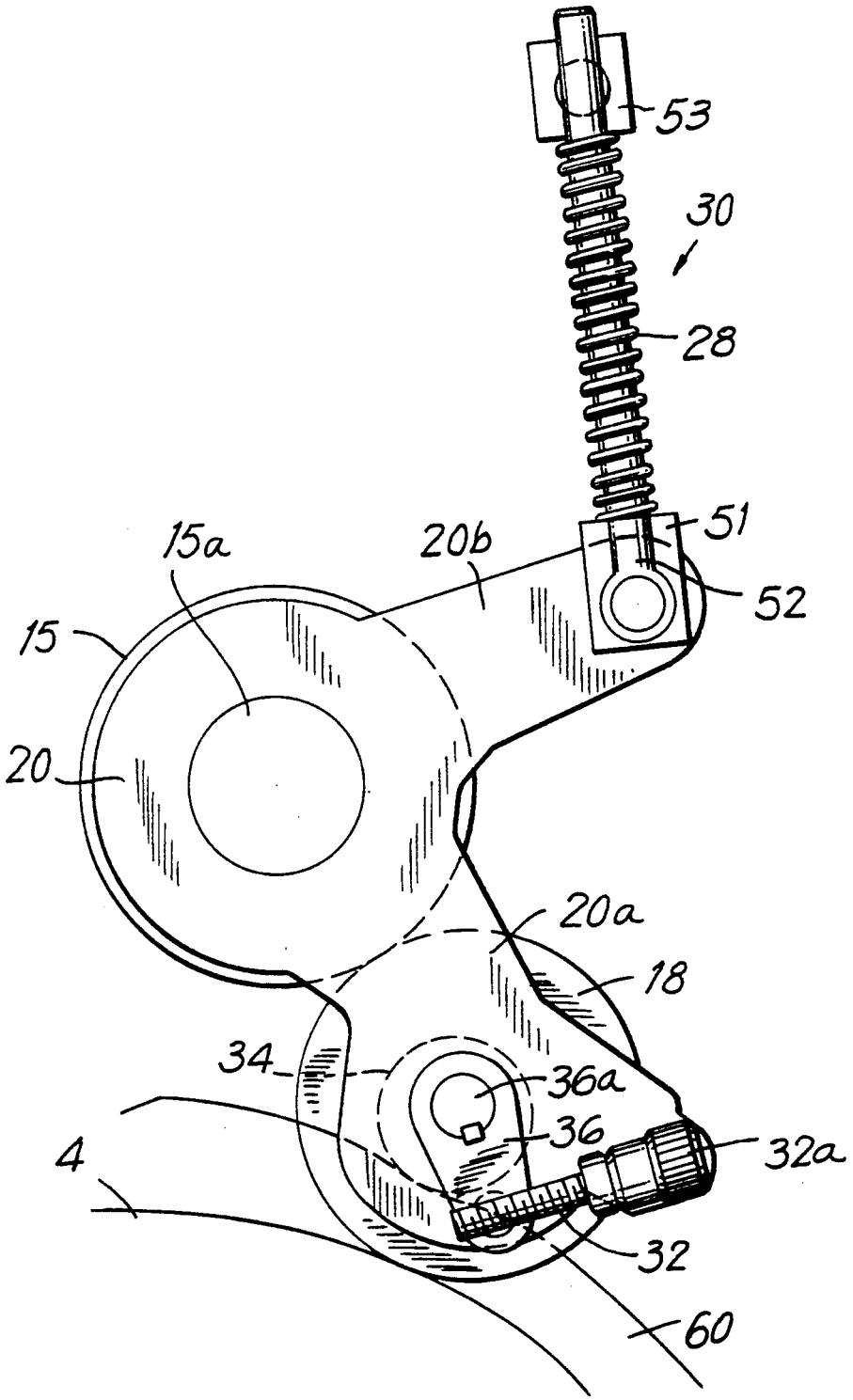
FIG. 5 is a schematic view showing part of the inking apparatus for a printing press of an embodiment according to the present invention.

End shafts 15a of the vibrating rollers 15 are mounted rotatably in pairs of roller arms 20 adjacent to each other. An ink form roller 18 contacting against the vibrating roller 15 is rotatably supported at one of front portions 20a of the roller arms 20. As shown in FIG. 5, front portions 20b of the roller arms 20 are rotatably linked with one end of a first spring holder member 51 and a guide bar 52. At the other end of the guide bar 52, a second spring holder member 53 is slidably engaged with the guide bar 52. The second spring holder member 53 is rotatably mounted to the frame 1, and the portion of the guide bar 52 between the second spring holder 53 and the first spring holder 51 is wound around with a coil spring 28 so as to extend the section between the spring holder members 51 and 53. Therefore, a rotating force about the end shaft 15a is applied to the roller arm 20b by the compression coil spring 28.

Thus, the ink form roller 18 is pressed towards the plate cylinder 4 by a force generated by a pressure member 30 comprising the spring holder members 51 and 53, the guide bar 52, and the compression coil spring 28.

Figure 3:
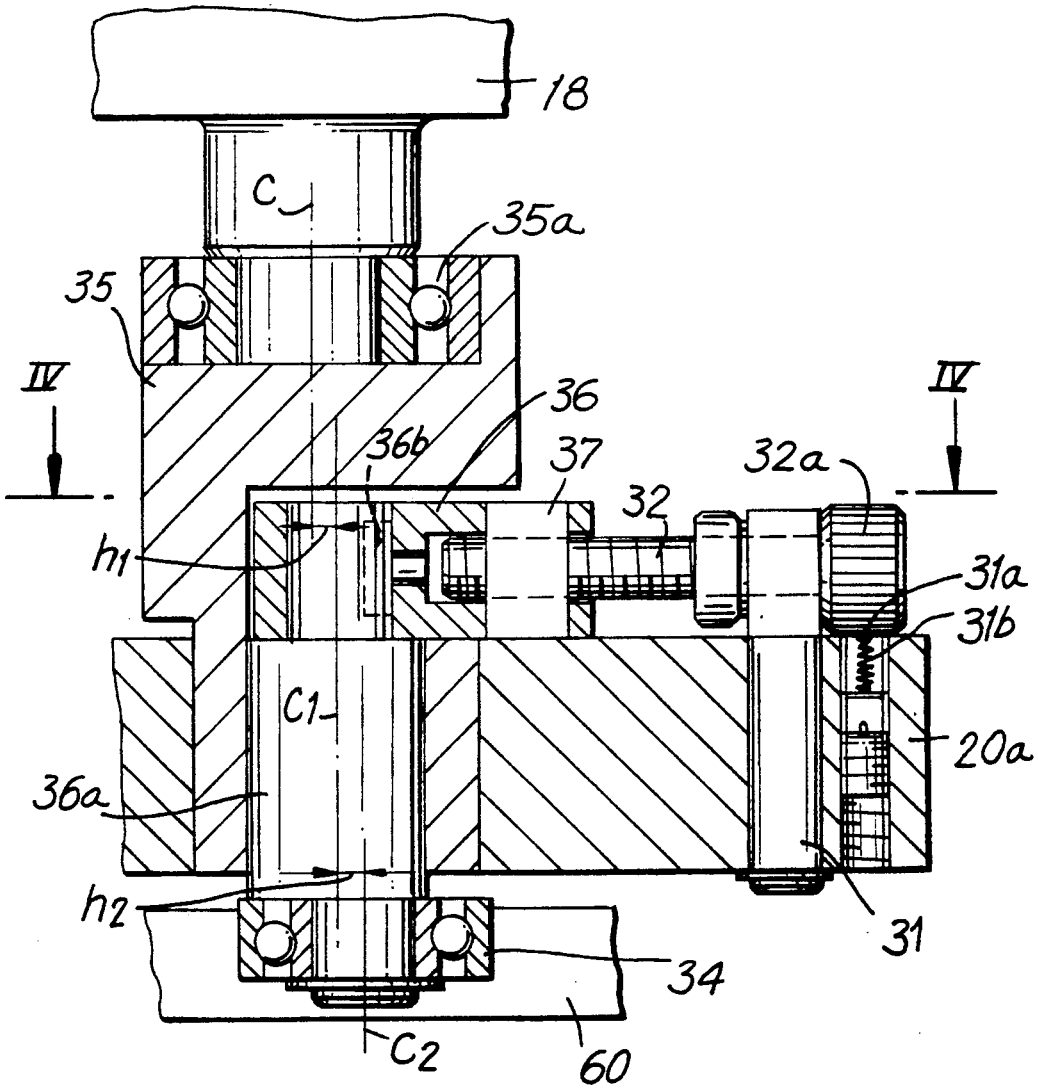
FIG. 3 is a schematic enlarged cross sectional view showing part A of FIG. 2.

Furthermore, as shown in FIG. 3, the ink from roller 18 is supported rotatably about shaft center C on a holder 35 through a bearing 35a. The holder 35 is rotatably engaged with a rotary shaft 36a connected with a rotary lever 36 through a key 36b. The shaft center $C_1$ of the rotary shaft 36a has an eccentricity $h_1$ with respect to the shaft center C. At the lower end of the shaft 36a is mounted a cam follower 35, of which the outer peripheral surface rotatably contacts against a cam 60, and shaft center $C_2$ of the cam follower 34 has an eccentricity $h_2$ with respect to the shaft center C1. As shown in FIGS. 1 and FIG. 2, the cam 60 is rotatable relative to the plate cylinder 4, and is supported by a bearing holder 7 so that it is concentric with shaft center $F_2$ of the plate cylinder 4.

The holder 35, as shown in FIG. 3, is supported on the roller arm 20a. The rotary lever 36 is engaged with an adjusting pin 37. An adjustment screw 32 threaded into the adjusting pin 37, is carried by a pin 31 rotatably supported by the roller arm 20. Furthermore, the roller arm 20 incorporates a loosening prevention mechanism for the adjusting screw 32, comprising a ball 31a, and a spring 31b pressing against a knurled knob 32a of the adjusting screw 32.

Figure 4:
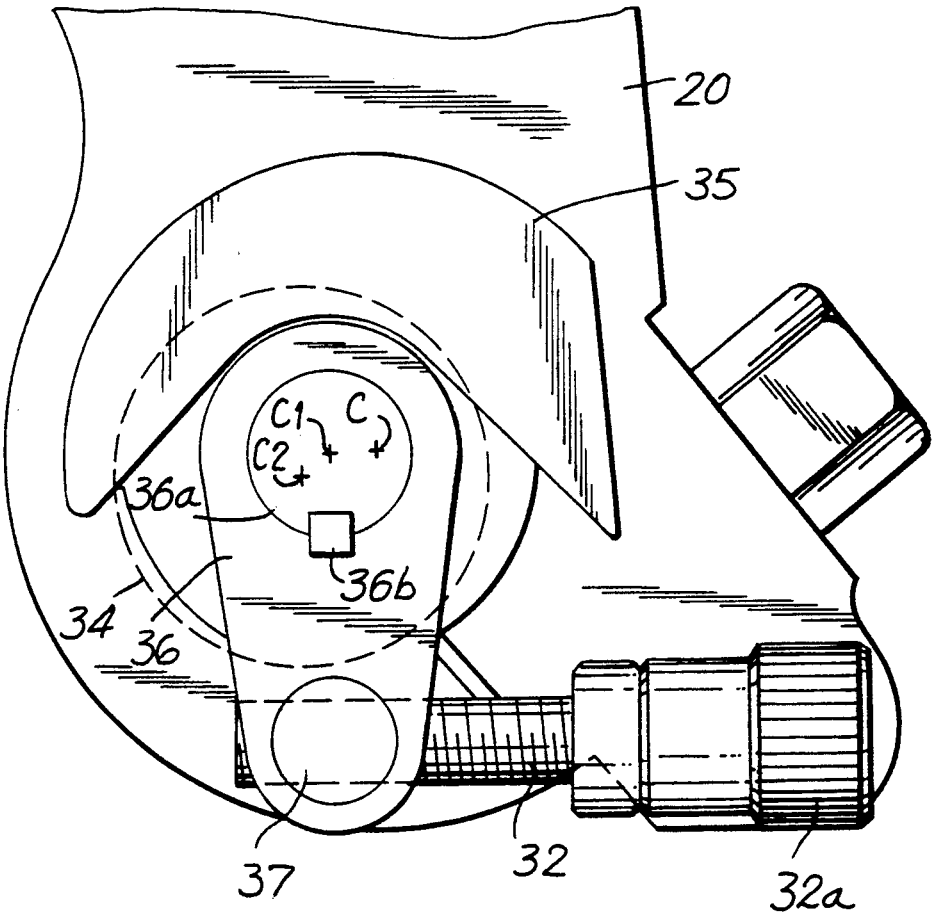
FIG. 4 is a schematic view taken along line IV—IV of FIG. 3.

Therefore, when the adjusting screw 32 is rotated, it pushes the adjusting pin 37 to the upper left side in FIGS. 4 and 5, or, reverts it back to the right side. This causes the rotary lever 36 and the rotary shaft 36a to rotate relative to the holder 35. As a result, the shaft center $C_2$ of the cam follower 34 is moved on an orbital path about the shaft center $C_1$, and the position of the shaft center $C_2$ varies relative to the shaft center C of the ink form roller 18.

Thus, through the movement of the cam follower 35, the position of the ink form roller 18 can be varied relative to the plate cylinder 4 in the radial direction, thereby adjusting the nip pressure.

Referring to FIGS. 2, an air cylinder 41 is rotatably mounted to the frame 1 (not shown) through a pin 43. A cylinder rod 44 of the air cylinder 41 is linked to a lever 45 by a pin 47. The rear end of the lever 45 is swingably supported on the frame 1 by a pin 46. The lever 45 is connected to a rod 49 by a pin 48. Furthermore, the cam 60 is connected with the front end of the rod 49 by a pin 50, so that the cam can be angularly adjusted by the rod 49.

Therefore, when the cylinder rod 44 of the air cylinder 41 extends, the cam 60 is rotated clockwise through swinging of the lever 45 and sliding of the rod 49. As a result, the cam follower 34 contacting against the cam 60 is moved in the radial direction of the plate cylinder 4, thus releasing the ink form roller 18 from the plate cylinder 4.

Thus, during printing, the cam 60 is fixed in the position shown in FIG. 2, and ink form roller 18 is pressed against the plate cylinder 4. When not printing, the cam 60 is rotated clockwise to push up the cam follower 34 in the radial direction, thereby releasing the ink form roller 18 from the plate cylinder 4.

With the above-described arrangement, even when the skewing adjustment is made after the nip pressure is adjusted by the adjusting screw 32, the cam follower 34 follows the movement of the cam 6 due to the pressing force of the pressure member 30, thereby eliminating the need for nip pressure readjustment.

In this embodiment, the pressing force is generated by the compression coil spring 28. The pressing force can alternatively be generated using other conventional means known in the art, such as an air cylinder.

What is claimed is:

1. An inking apparatus for a printing press comprising:

a printing cylinder having a longitudinal axis;

an ink form roller having first and second opposite ends and a longitudinal axis;

first and second support means for rotatably mounting said ink form roller at its first and second opposite ends, respectively, and for movement towards and away from the printing cylinder;

means to independently adjust the pressure exerted by said ink form roller on the printing cylinder at a selected end of said ink form roller relative to the pressure exerted by said ink form roller on the printing cylinder at the other end of said ink form roller, said means including means for biasing said ink form roller towards the printing cylinder;

adjustable eccentric means carried by said support means for skewing of the longitudinal axis of said ink form roller relative to the longitudinal axis of the printing cylinder;

said eccentric means having journals for the opposite ends of said ink form roller;

cam means rotatably mounted concentric with the printing cylinder, and rotary cam follower means cooperating with said cam means;

means for rotating said cam means angularly between a first position and a second position;

said rotary cam follower means being in mechanical cooperation with said cam means and said means for rotating said cam means and for moving said ink form roller into and out of contact with the printing cylinder when the cam means is in the first position and the second position, respectively;

second eccentric means carried by each of said first and second support means, and providing journals for said rotary cam follower means;

manual adjustment means for rotating said second eccentric means through a predetermined angle of rotation, whereby, the pressure exerted by said ink form roller on the printing cylinder at one of said ends of said ink form roller is independently adjustable relative to the pressure exerted by said ink form roller on the printing cylinder at said other end of said ink form roller.

2. The inking apparatus of claim 1, in which said second eccentric means includes a shaft journalled for rotation in an associated said support means, said shaft having an eccentric extension of said shaft providing a journal for said rotary cam follower means, an arm keyed to said shaft, and, screw-threaded means engaged with said arm for adjusting the angular position of said arm and said second eccentric means about the longitudinal axis of said shaft.

3. The inking apparatus of claim 1, in which said means for rotating said cam means is a fluid-operated piston and cylinder arrangement.

4. The inking apparatus of claim 2, in which said screw-threaded means includes a screw-threaded shaft, and a post having a longitudinal axis and a screw-threaded aperture, said post being journalled on an associated said support means for rotation about an axis perpendicular to the longitudinal axis of said post.

5. The inking apparatus of claim 4, including a nut having a longitudinal axis and journalled for rotation in said arm about an axis perpendicular to the longitudinal axis of said nut, said screw-threaded shaft being supported in said post against axial movement, and, being threadedly engaged within said nut.

6. The inking apparatus of claim 2, including: abutment surfaces on said screw threaded means, and means for restraining said screw-threaded means against unintended rotary movement, comprising a spring-loaded ball supported by said support means, and which reacts against said abutment surfaces of said screw-threaded means.

* * * * *